United States Patent [19]

Pfarrwaller

[11] Patent Number: 4,655,260

[45] Date of Patent: Apr. 7, 1987

[54] SHUTTLE PROJECTILE FOR A WEAVING MACHINE

[75] Inventor: Erwin Pfarrwaller, Winterthur, Switzerland

[73] Assignee: Sulzer Brothers Limited, Winterthur, Switzerland

[21] Appl. No.: 849,686

[22] Filed: Apr. 9, 1986

[30] Foreign Application Priority Data

Apr. 27, 1985 [EP] European Pat. Off. ..... 85105182.1

[51] Int. Cl.[4] ..... D03J 5/06

[52] U.S. Cl. ..... 139/196.2

[58] Field of Search ..... 139/196.1, 196.2, 196.3

[56] References Cited

U.S. PATENT DOCUMENTS 4,120,329 10/1978 Hintsch ..... 139/196.2

4,508,146 4/1985 Hintsch ..... 139/196.2

*Primary Examiner*—Henry S. Jaudon

*Attorney, Agent, or Firm*—Kenyon & Kenyon

[57] ABSTRACT

The projectile housing is made with thin-wall section at least in the central third of the housing. In addition, internal projections are provided on the housing walls in order to support the thin-wall section of the housing on the clamping arms of the weft thread clamp. In one embodiment, the thin-wall section may be formed by a sleeve which is joined in opposite ends to the remainder of the projectile housing. Alternatively, the sleeve may extend to the rear end of the housing while being supported on enlarged jaws located on the ends of the clamping yarns.

17 Claims, 11 Drawing Figures

SHUTTLE PROJECTILE FOR A WEAVING MACHINE

This invention relates to a shuttle projectile for a weaving machine. More particularly, this invention relates to a shuttle projectile of limited weight.

Heretofore, it has been known to provide shuttle projectiles for weaving machines of a construction which includes a weft yarn clamp having a pair of clamping arms and a housing which receives the yarn clamp. Generally, the yarn clamp includes a yoke which is connected to a forward end of the projectile housing while the clamping arms extend from the yoke toward the rear end of the projectile housing. In some cases, for example, as described in U.S. Pat. No. 4,508,146 recesses have been made in the interior of the housing to enlarge the space within the housing for the yarn clamp. Usually, these recesses have a cross-section which is substantially constant over a longitudinal section of the housing which extends substantially over the central third of the housing. As a result, the cross section of the housing is greater than the cross section of the yarn clamp within this central section. However, the wall portions of the housing in this central section have been made of thicknesses which ensure sufficient rigidity of the housing, particularly, during deceleration (i.e. braking) of the projectile after a weft insertion while simultaneously providing a reduction in weight of the projectile.

It is an object of the invention to provide an improved shuttle projectile of rigid construction and relatively low mass.

It is another object of the invention to provide a shuttle projectile of limited weight which is combined with an improved or at least equal form stability to previously known shuttle projectiles.

It is another object of the invention to provide for a reduction in weight of a shuttle projectile without altering the outer contour of the projectile and the braking surface of the projectile.

Briefly, the invention provides a shuttle projectile for a weaving machine which is comprised of a weft thread clamp having a yoke at one end and a pair of clamping arms extending from the yoke and an elongated housing having an internal cavity receiving the clamp. In accordance with the invention, the housing is spaced peripherally from the clamping arms at least over a central third of the length of the housing and has at least one internal projection within the cavity with a support surface slidably contacting and supported on at least one of the clamping arms.

In one embodiment, the housing is provided with groove-like depressions which are arranged in side-by-side relation and which are separated from each other by ridge-like projections (or elevations) which project inwardly in order to cooperate with at least one of the clamping arms.

The internal projections on the housing permit the projectile to have a substantially reduced wall thickness, at least in the central longitudinal section of the housing, as compared with previously known constructions, and hence, a corresponding reduction of the mass of the projectile to be accelerated and decelerated. At the same time, due to the support of the housing, which in this case may be relatively flexible, on the clamping arms, the rigidity of the projectile in the longitudinal direction is ensured by the corresponding rigidity of the clamping arms. Thus, an undesired deformation of the projectile housing which is stiffened by the clamping arms is prevented, particularly, during deceleration of the projectile which is necessary after each weft insertion, for example into the shed of a weaving machine.

The reduction of the mass of the projectile which is obtained permits a reduction of the necessary brake power in the catching mechanism of a weaving machine and, hence, leads to a correspondingly reduced wear of the brake fittings of the catching mechanism. Thus, particularly in weaving machines having high weft insertion capacities in which the projectiles enter a catching mechanism at correspondingly high frequency and correspondingly high entrance speed, the useful life of the brake fittings in the catching mechanism can be substantially increased as compared with previously known projectiles.

The projections for the housing may each be formed by a longitudinal rib which extends in the longitudinal direction of the housing over the clamp. This permits, for example, the use of sections of hollow-section rods which can be manufactured relatively inexpensively, for instance, by draw-pressing, for the production of the correspondingly shaped portions of the projectile housing. This construction permits an especially expedient manufacture of the projectile housing.

The projectile housing may also be formed of a pair of longitudinally disposed parts which are permanently joined together in a plane extending parallel to the clamping arms of the clamp. In this case, the advantages of an especially inexpensive separate production of the two housing parts, for example by precision casting or drop forging, can be combined with an easily producable joining of the two housing parts together, for example by welding or soldering. Thus, a major reduction in the cost of manufacture can be obtained.

In still other embodiments, the projections may be formed as transversely disposed ribs which may peripherally surround the clamping arms or which may be disposed in chevron-shapes. In addition, the housing may be formed, at least in part, of a sleeve which extends in spaced peripheral relation to the clamping arms within the central section. Such a sleeve may also extend to the free ends of the clamping arms while each arm is provided with a jaw which is enlarged so as to support the end of the sleeve thereon.

These and other objects and advantages of the invention will become more apparent from the following detailed description taken in conjunction with the accompanying drawings wherein.

Figures 1, 2, 3, 4, 5, 6:
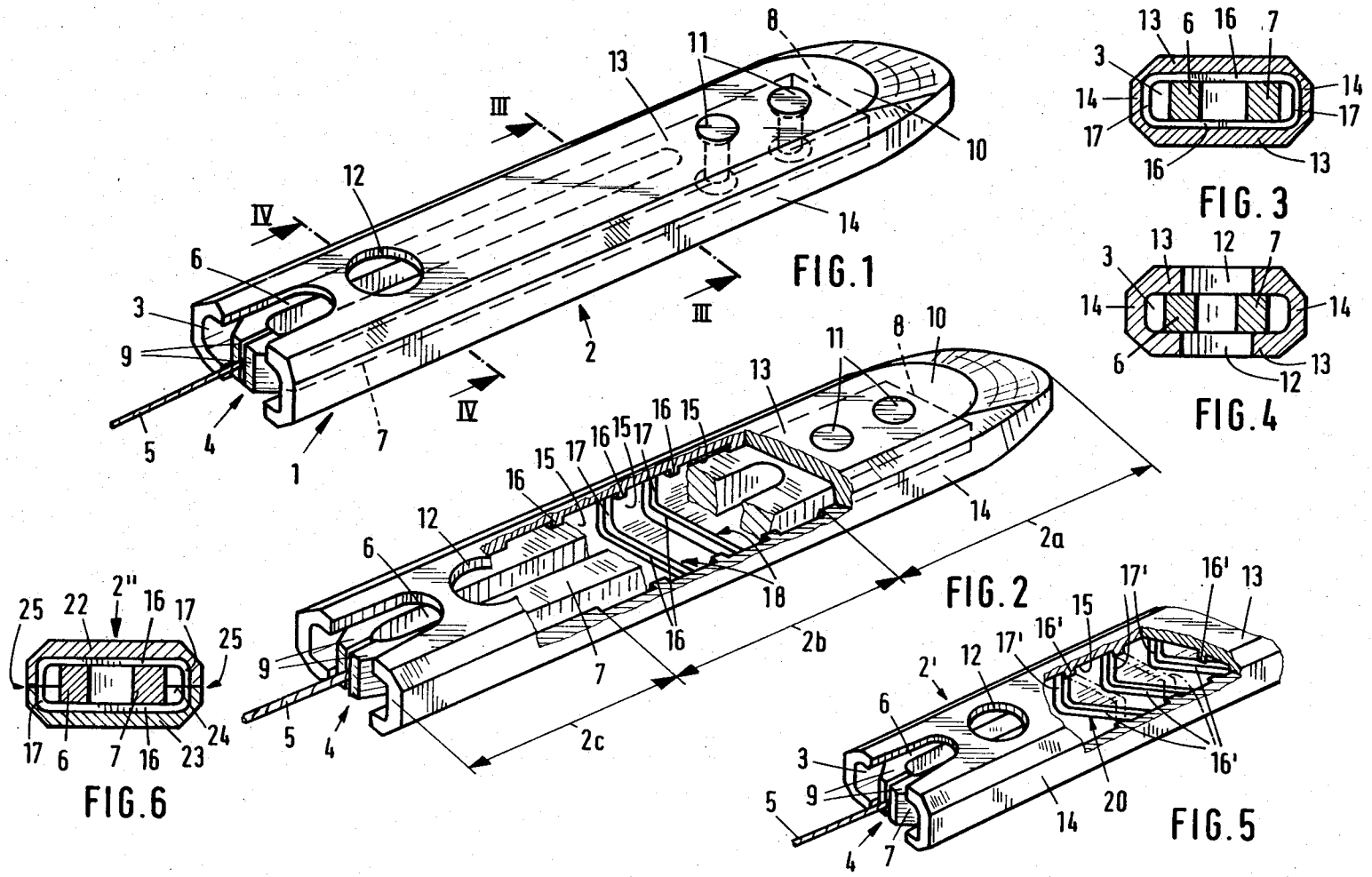
FIG. 1 illustrates a perspective view of a shuttle projectile constructed in accordance with the invention.
FIG. 2 illustrates the shuttle projectile of FIG. 1 with a cut-away portion to show the interior of the projectile housing.
FIG. 3 illustrates a view taken on line III—III of FIG. 1.
FIG. 4 illustrates a view taken on line IV—IV of FIG. 1.
FIG. 5 illustrates a perspective partial view of a modified shuttle projectile having chevron-shaped projections in accordance with the invention.
FIG. 6 illustrates a cross sectional view of a modified shuttle projectile housing in accordance with the invention.

Referring to FIG. 1, the shuttle projectile 1 is constructed and sized for use in a weaving machine, for example, for picking through a shed produced within the weaving machine. As illustrated, the shuttle projectile 1 includes a projectile housing 2 which defines an internal cavity 3 and a weft thread clamp 4 which is received within the housing 2. As indicated, the clamp 4 serves to grip a weft thread 5 which is to be inserted into the shed of a weaving machine (not shown) and to release the weft thread 5 after completion of weft insertion.

The weft thread clamp 4 includes a pair of clamping arms 6, 7 which extend from a yoke 8 at one end of the clamp 4. The clamping arm 6, 7 are biased against each other under an initial tension so as to grip the weft yarn 5 between jaws 9 which are located at the respective ends of the arms 6, 7. The yoke 8 is secured by suitable means, for example a pair of rivits 11, to a head 10 of the projectile housing 2.

The clamping arms 6, 7 extend from the yoke 8 through the cavity 3 toward the rear end of the projectile housing 2. In addition, the housing 2 is provided with openings 12 in the wall portions which extend over the opposite sides of the clamping arm 6, 7 in order to permit the introduction of a clamp opener (not shown) between the clamping arm 6, 7 in order to spread the arms 6, 7 apart before the weft thread 5 is gripped or, respectively, released after weft insertion. By withdrawal of the clamp opener (not shown) the weft thread clamp 4 is closed and the clamping jaws 9 are biased against each other by the tensioned clamping arm 6, 7. In this respect, the construction of the shuttle projectile 1 is conventional. Further details of the construction can be obtained, for example from Swiss Patent No. 552,092.

The housing 2 is made of a generally flat rectangular cross-section or an octagonal cross-section. As indicated, the housing is open at the rear end so as to permit installation of the clamp 4 into the cavity 3. As indicated in FIG. 4, the housing has a pair of wide side walls 13 and a pair of narrow side walls 14 which have substantially equal wall thickness in two end sections 2*a*, 2*c* of the housing 2. As indicated in FIG. 2, the yoke 8 is firmly connected with the wide side walls 13 and possibly with the narrow side walls 14 while the free ends of the clamping arms 6, 7 are guided, as shown in FIG. 4, to slide along the wide side walls 13 in spaced relation to the narrow side walls 14.

The housing 2 has a thin-walled flexible section extending over the central third 2*b* of the length of the housing in spaced peripheral relation to the clamping arms 6, 7. In addition, this central section 2*b* includes internal projections 16, 17 within the cavity 3 with each having a support surface as indicated in FIG. 3 to slidingly contact and be supported on the clamping arms 6,7. In this respect, the wide side walls 13 and narrow side walls 14 are provided with groove-like depressions 15 which encircle the inner circumference of the housing 2; which depressions are separated from one another by the corresponding ridge-like projections 16, 17. The support surfaces of the projections 16, 17 may lie in the same planes as the interior surfaces of the two end sections 2*a*, 2*c* of the housing.

As indicated in FIG. 3, the support of the housing section 2*b* is effected via the projections 16 on the wide side walls 13 of the clamp 4. Due to this arrangement, the clamp 4 is made use of to stiffen the housing 2 so that the side walls 13, 14 do not come under bending stress or only very slightly so. The side walls 13, 14 can therefore be formed with correspondingly thin walls at least in the central longitudinal section 2*b* without impairing the formed stability of the projectile 1. It has been found that, without changing the external dimensions of the projectile 1, the mass of the projectile 1 can be reduced by about 10 to 20 percent as compared with previously known constructions.

As indicated in FIG. 2, three transverse ribs 18 are defined by the projections 16, 17. However, a greater or lesser number of ribs 18 may be provided. Alternatively, constructions are possible where only some or possibly a single one of the existing projections have a support surface suitable for cooperation with the clamping arms 6, 7.

Referring to FIG. 5, instead of transversely disposed ribs, the projections may be in the form of chevron-shaped ribs 20 which are longitudinally spaced apart within the housing 2. The cross rib may also be provided along a helical line. Of note, the projections 16' extending along the upper side wall 13 are indicated by dash-dot lines.

Referring to FIG. 6, the projectile housing 2" may be formed of a pair of longitudinally disposed parts 22, 23 which can be manufactured separately, for example, by precision casting or drop forging. The housing parts 22, 23 which may be identical can be placed one against the other with dividing faces 24 extending parallel to the length of the housing 2" and may have respective depressions bounded by projections 16, 17. The housing parts 22, 23 can be joined together along the dividing faces 24 by a permanent joint 25, for example by welding, soldering or gluing.

Figure 8:
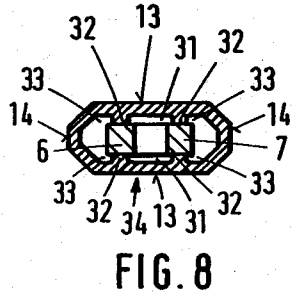
FIG. 8 illustrates a view taken on line VIII—VIII of FIG. 7.
Figure 7:
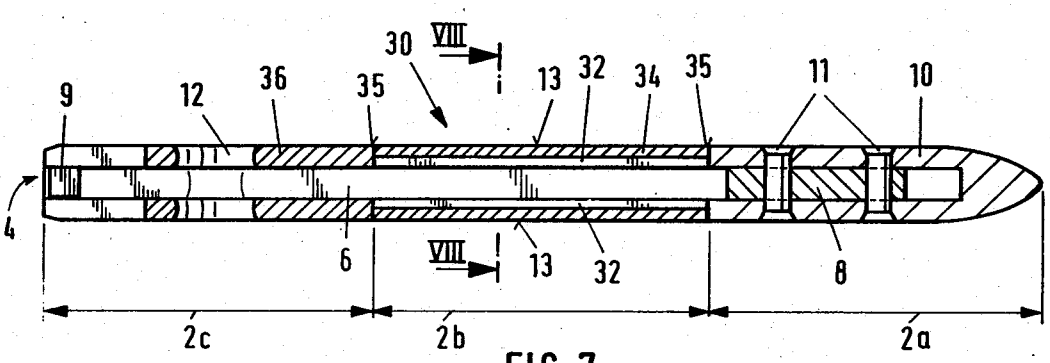
FIG. 7 illustrates a modified shuttle projectile having a sleeve within a central section of the housing in accordance with the invention.

Referring to FIGS. 7 and 8, wherein like reference characters indicate like parts as above, the projectile housing 30 may have groove-like depressions 31, 33 extending longitudinally in parallel to the length of the housing 30 while being separated by ridge-like projections 32 in the form of longitudinal ribs. As indicated in FIG. 8, a pair of longitudinal ribs 32 are provided on each side wall 13 so as to separate three depressions 31, 33. In addition, each rib 32 is supported on a respective clamping arms 6,7.

Referring to FIG. 7, the central section 2*b* of the housing may be in the form of a sleeve 34 which is connected by a permanent joint 35 with a head 10 and a second sleeve 36 which extends over the rear end section 2*c*. Alternatively, the two sleeves 34, 36 may be made in one piece. In addition, the sleeves 34, 36 and head 10 may also be made in one piece.

Figure 10:
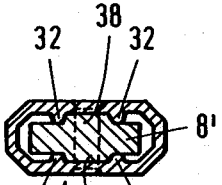
FIG. 10 illustrates a view taken on line X—X of FIG. 9.
Figure 9:
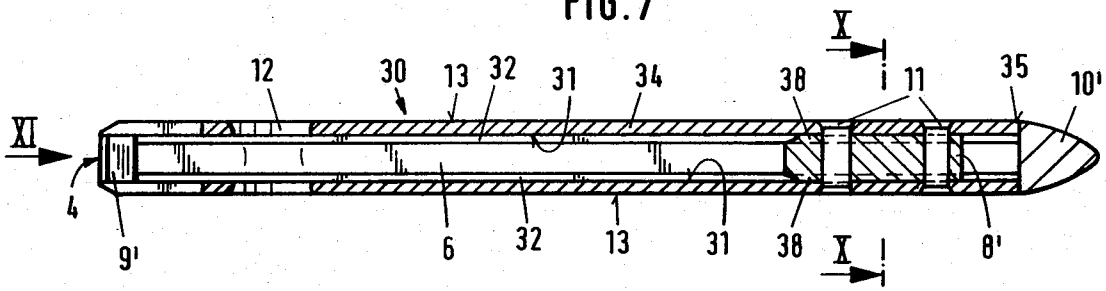
FIG. 9 illustrates a cross sectional view of a further modified shuttle projectile in accordance with the invention.

Referring to FIGS. 9 and 10, wherein like reference characters indicate like parts as above, the projectile housing may be provided with a sleeve 34 which extends essentially over the entire length of the projectile and which is connected directly with the weft thread clamp 4 via the rivits 11 while being closed at the forward end by way of a head 10'. In this embodiment, the weft thread clamp 4 has a yoke 8' on which two strip-like support portions 38 for the sleeve 34 are formed which can be introduced into the respective depressions 31.

Figure 11:
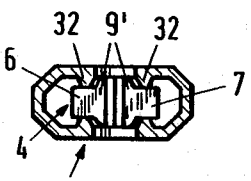
FIG. 11 illustrates a view taken in the direction indicated by the arrow XI in FIG. 9.

Referring to FIGS. 9 and 11, the clamping arm 6, 7 may be provided with jaws 9' at the respective ends which are of greater thickness than the arms 6, 7. In this case, the arms 6,7 are essentially over their entire length in sliding contact with the ribs 32 in order to support the sleeve 34 thereon. As shown in FIG. 11 the jaws 9' protrude into the depressions 31 and are particularly useful for the gripping of thick weft threads and/or threads consisting of several fibers.

The invention thus provides a projectile of reduced mass while, at the same time, providing a projectile of relatively rigid construction which is able to withstand repeated braking in the catching mechanisms of weaving machines.

The invention also provides a shuttle projectile which can be manufactured in a relatively simple manner in order to provide for a reduced weight while also providing stability in use.

What is claimed is:

1. A shuttle projectile for a weaving machine comprising a weft thread clamp having a yoke at one end and a pair of clamping arms extending from said yoke; and an elongated housing having an internal cavity receiving said clamp, said housing having a thin-walled flexible section spaced peripherally from said clamping arms at least over a central third of the length of said housing and having at least one internal projection within said flexible section with a support surface slidably contacting and supported on at least one of said clamping arms.

2. A shuttle projectile as set forth in claim 1 wherein each projection is a longitudinally disposed rib.

3. A shuttle projectile as set forth in claim 1 wherein each projection is a transversely disposed rib peripherally surrounding said clamping arms.

4. A shuttle projectile as set forth in claim 1 wherein each projection is a chevron shaped rib.

5. A shuttle projectile as set forth in claim 1 wherein said housing includes a head at one end and a sleeve secured to and extending from said head about said clamping arms.

6. A shuttle projectile as set forth in claim 1 wherein said housing is formed of a pair of longitudinally disposed parts permanently joined together in a plane extending parallel to said clamping arms.

7. A shuttle projectile for a weaving machine comprising a weft thread clamp having a yoke at one end and a pair of clamping arms extending from said yoke;

an elongated housing receiving said clamp and having a thin-walled flexible section extending at least over a central third of the length of said housing in spaced peripheral relation to said clamping arms, said housing including projections within said thin-walled flexible section supporting said housing on said clamping arms; and means securing said yoke to said housing.

8. A shuttle projectile as set forth in claim 7 wherein said housing includes a plurality of longitudinally disposed depressions disposed in alternating relation with a pair of longitudinally disposed projections on each of two opposite sides of said housing to define said thin-walled section.

9. A shuttle projectile as set forth in claim 7 wherein said projections are transversely disposed and longitudinally spaced apart relative to said clamping arms.

10. A shuttle projectile as set forth in claim 7 wherein said projections are chevron-shaped and longitudinally spaced apart relative to said clamping arms.

11. A shuttle projectile as set forth in claim 7 wherein said housing includes a sleeve extending in spaced peripheral relation to said clamping arms and each arm has a jaw at one end slidably received within said sleeve.

12. A shuttle projectile as set forth in claim 11 wherein said housing includes a head secured to said sleeve at an end opposite said jaws.

13. A shuttle projectile as set forth in claim 12 wherein said means secures said sleeve to said yoke between a pair of said projections on each of two opposite sides of said sleeve.

14. A shuttle projectile as set forth in claim 7 wherein each projection peripherally surrounds said clamping arms.

15. A shuttle projectile for a weaving machine comprising a weft thread clamp having a yoke at one end and a pair of clamping arms extending from said yoke, each said arm having a jaw at a second end thereof of a greater thickness than said respective arm; and an elongated housing having an internal cavity receiving said clamp, said housing being spaced peripherally from said clamping arms at least over a central third of the length of said housing and having a pair of internal projections within said cavity defining a depression therebetween, each projection having a support surface slidably contacting a respective one of said clamping arms to support said housing thereon with said jaws protruding into said depression.

16. A shuttle projectile as set forth in claim 15 wherein each projection is a longitudinally disposed rib.

17. A shuttle projectile as set forth in claim 15 wherein said housing is formed of a pair of longitudinally disposed parts permanently joined together in a plane extending parallel to said clamping arms.

* * * * *